US005738018A

United States Patent [19]

Burnett

[11] Patent Number: 5,738,018

[45] Date of Patent: Apr. 14, 1998

[54] TABLE WITH RISING BUBBLE DISPLAY

[75] Inventor: Kenneth Burnett, Lincolnwood, Ill.

[73] Assignee: Midwest Tropical, Inc., Lincolnwood, Ill.

[21] Appl. No.: 787,970

[22] Filed: Jan. 23, 1997

[51] Int. Cl.[6] ..... A47B 85/00

[52] U.S. Cl. ..... 108/23; 108/161

[58] Field of Search ..... 108/23, 24, 161, 108/50, 150; 119/247, 254; 362/97, 410, 412

[56] References Cited

U.S. PATENT DOCUMENTS

| | | | |
|---|---|---|---|
| D. 348,535 | 7/1994 | Burnett . | |
| 1,723,272 | 8/1929 | Emma | 119/247 X |
| 1,846,878 | 2/1932 | Kopp | 108/23 X |
| 2,133,740 | 10/1938 | Donohoue | 108/50 X |
| 2,503,945 | 4/1950 | Grossniklaus | 119/247 |
| 3,185,829 | 5/1965 | Rau | 119/247 |
| 3,807,356 | 4/1974 | Pratt | 119/247 |
| 4,876,969 | 10/1989 | Infanti | 108/24 |
| 5,171,060 | 12/1992 | Kaye | 108/23 X |
| 5,349,771 | 9/1994 | Burnett . | |

FOREIGN PATENT DOCUMENTS

| | | | |
|---|---|---|---|
| 770311 | 9/1934 | France | 108/23 |

OTHER PUBLICATIONS

Brochure "Water Panels", Midwest Tropical, Inc. Lincolnwood, Illinois, 1995.

*Primary Examiner*—Jose V. Chen
*Attorney, Agent, or Firm*—Brinks Hofer Gilson & Lione

[57] ABSTRACT

A table includes a table top that is supported by a set of legs. Each of these legs includes a translucent column adapted to contain a liquid and a bubble source mounted in the column to introduce bubbles in the liquid. A pump is coupled to the bubble sources to supply a pressurized fluid such as air to the bubble sources. The fluid forms bubbles which rise through the liquid and are visible from outside the columns. Preferably, all of the legs of the table include a respective column and bubble source, and the bubbles in the columns are illuminated by light from one or more light sources contained in the base adjacent the lower portion of the legs. Colored filters may be interposed between the light and source and the columns.

31 Claims, 3 Drawing Sheets

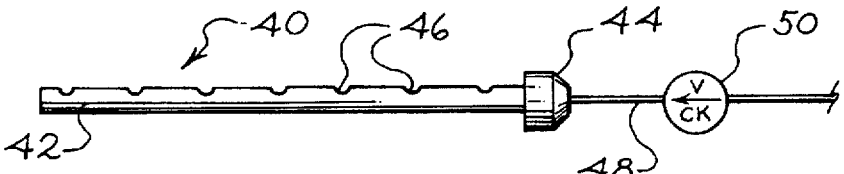
Fig. 5
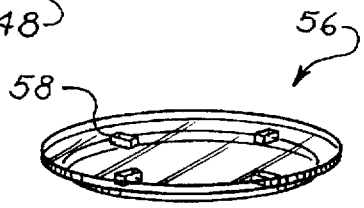
Fig. 6
Fig. 7
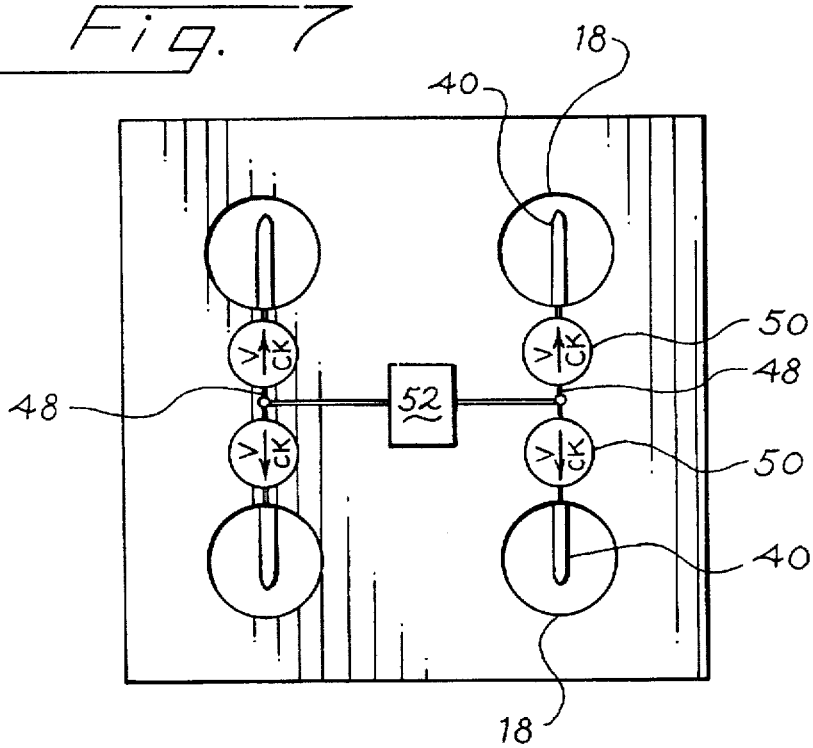
Fig. 8
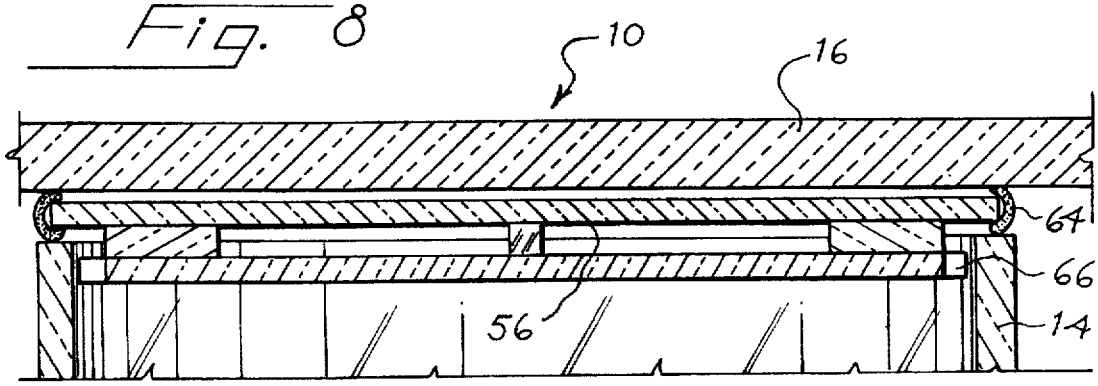

TABLE WITH RISING BUBBLE DISPLAY

BACKGROUND OF THE INVENTION

This invention is directed to a table having a new structure that provides a distinctive function and appearance.

Tables come in many forms, including four-legged tables and single-legged pedestal tables. Conventionally, tables are static devices in use, and they do not provide a dynamic ornamental aspect.

Rising bubble display devices such as those described in U.S. Pat. Nos. 5,349,771 and Des. 348,535 (both assigned to the assignee of the present invention) are known to the art. Such display devices are highly ornamental, but the devices shown in these patents are panels which are sculptural ornamental items. They are typically used in application which place no functional requirement on the display panel.

Applicant has discovered a new table which provides dynamic ornamental and functional aspects.

SUMMARY OF THE INVENTION

According to this invention, a table is provided comprising a top and a set of legs supporting the top. At least one of these legs includes a translucent column adapted to contain a liquid, and a bubble source mounted in the column to introduce bubbles into the liquid. A pump is coupled to the bubble source to supply pressurized fluid such as air to the bubble source such that the fluid forms bubbles which rise through the liquid and are visible from outside the column.

Preferably, the set of legs includes multiple legs, and each of the legs includes a respective column and bubble source. Also, it is preferable that the table include one or more light sources mounted to direct light upwardly to illuminate the bubbles in the columns.

BRIEF DESCRIPTION OF THE DRAWINGS

FIG. 5 is a side view of a bubble source used in the table of FIGS. 1 through 4.

FIG. 6 is a perspective view of a cap used in the table of FIGS. 1 through 4.

FIG. 7 is a schematic view showing air pump connections in the table of FIGS. 1 through 4.

FIG. 8 is a fragmentary sectional view taken along line 8—8 of FIG. 2.

DETAILED DESCRIPTION OF THE PRESENTLY PREFERRED EMBODIMENTS

Figure 1:
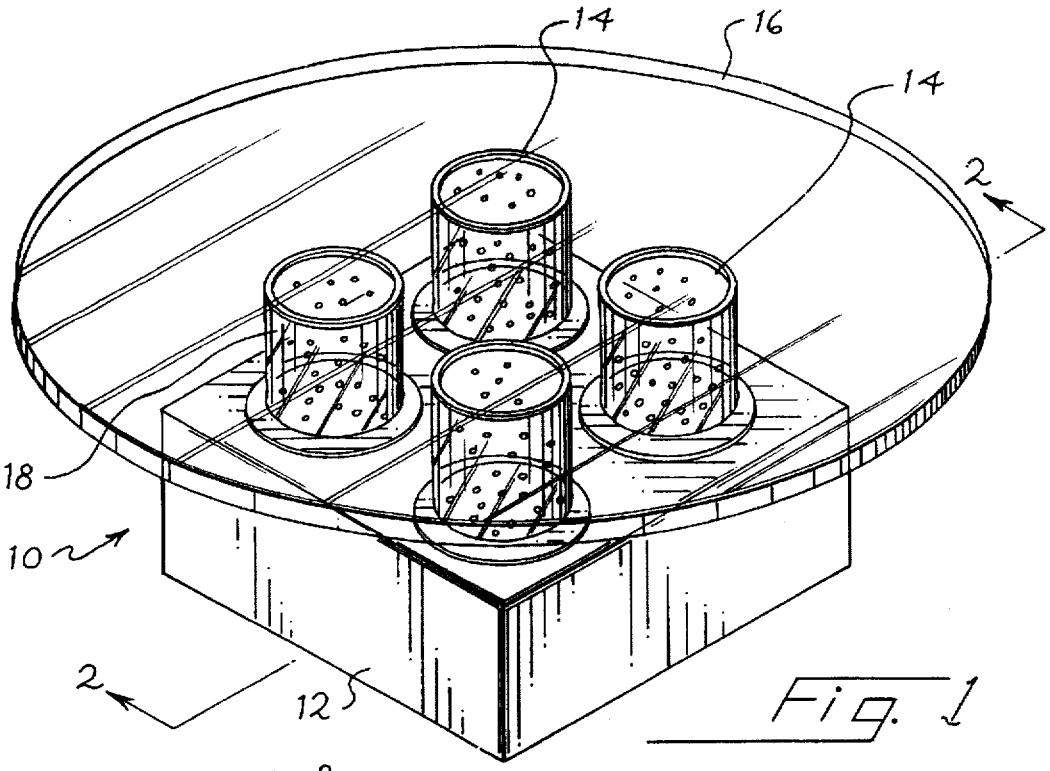
FIG. 1 is a perspective view of a table which incorporates a preferred embodiment of the present invention.

Turning now to the drawings, FIG. 1 shows a perspective view of a table 10 that incorporates a presently preferred embodiment of this invention. The table 10 includes a base 12, which supports four legs 14. The legs in turn support a table top 16.

Each of the legs 14 includes a translucent column 18 which in this embodiment is substantially transparent. Each of the columns 18 forms a water-tight reservoir adapted to contain a liquid such as water without leaking.

Figure 2:
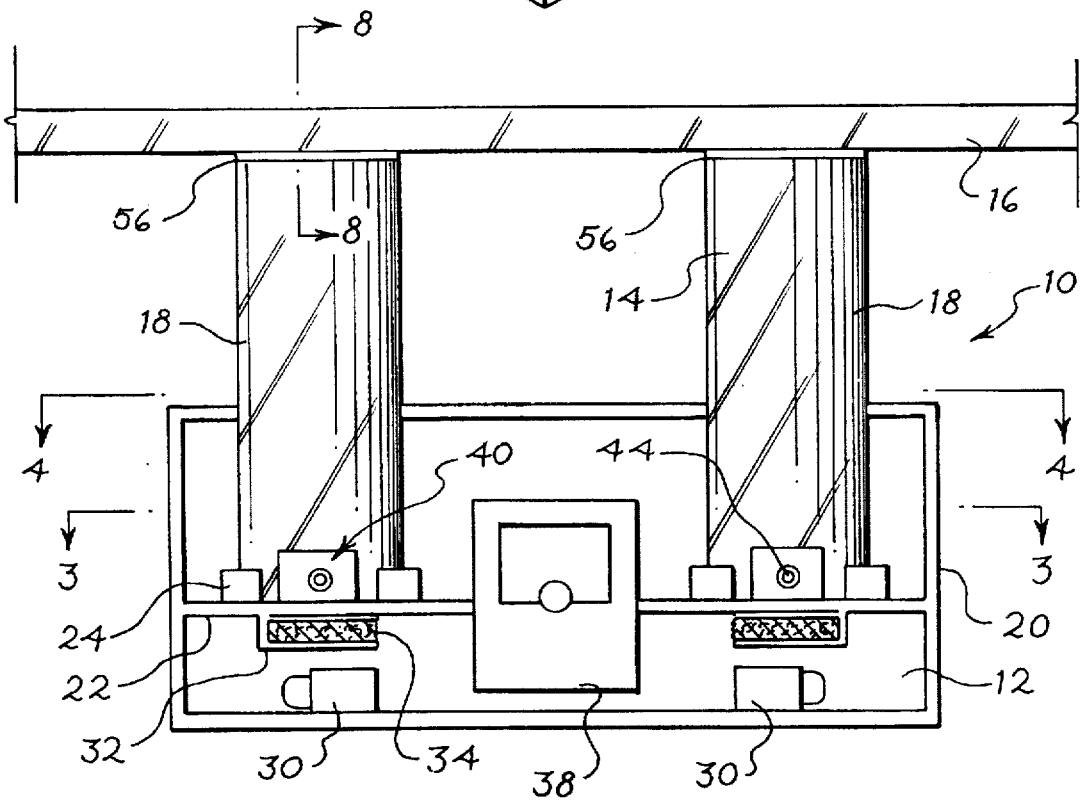
FIG. 2 is a cross-sectional view taken along line 2—2 of FIG. 1.
Figure 3:
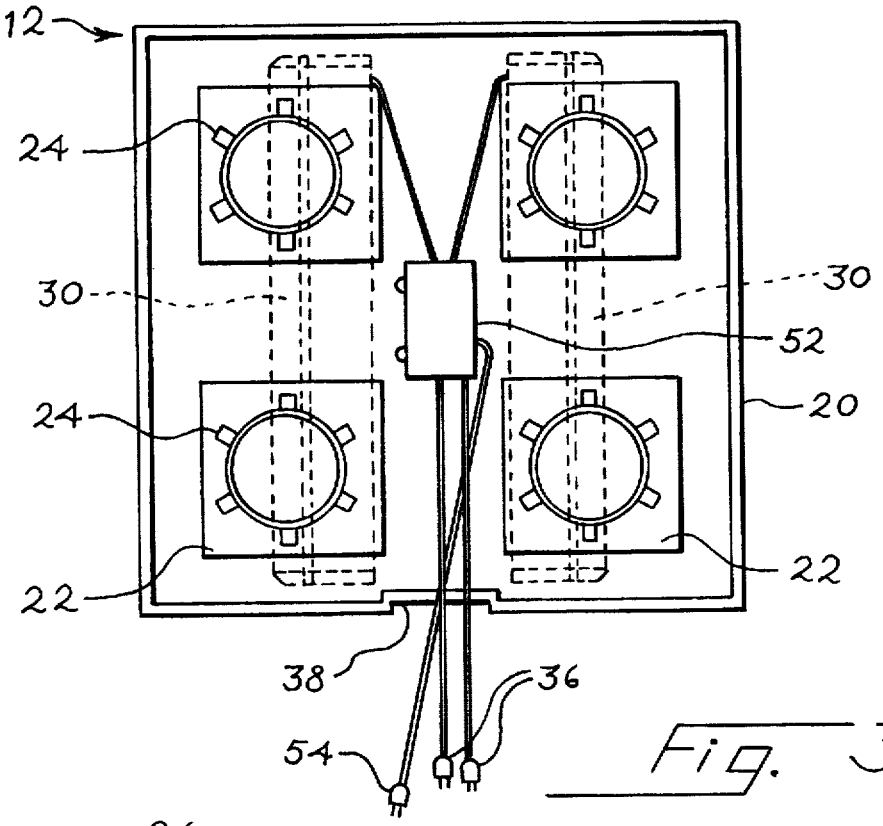
FIG. 3 is a cross-sectional view taken along line 3—3 of FIG. 2.
Figure 4:
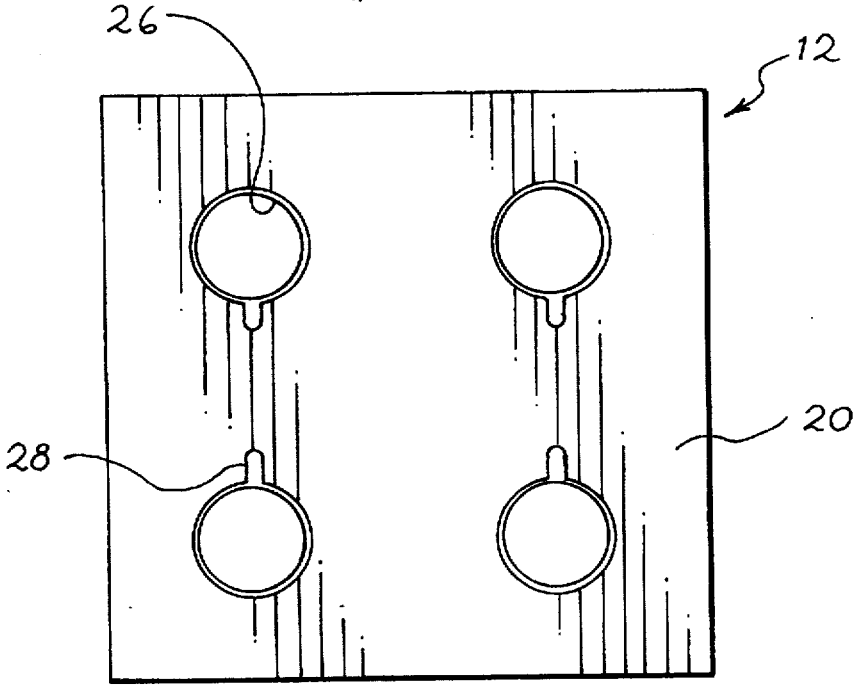
FIG. 4 is a cross-section view taken along line 4—4 of FIG. 2.

As best shown in FIGS. 2, 3 and 4, the base 12 includes an outer housing 20 that conceals from view a number of internal components, including a transparent acrylic column support 22. The column support 22 includes four circular arrays of clear acrylic lugs 24 which positively position the lower end of the respective columns 18. As shown in FIG. 4, the upper surface of the housing 20 defines four cutouts 26 which are generally shaped to match the outer surface of the columns 18. In addition, each of the cutouts 26 defines a notch 28 that is useful during assembly, as described below.

Two light sources 30 are positioned in the base 12 beneath the column support 22. In this embodiment, each of the light sources 30 can take the form of a fluorescent tube, though incandescent and other suitable light sources can be substituted. The light sources 30 emit light which passes through the transparent support 22 and the transparent base of the columns 18 to illuminate the interior of the columns 18 from below.

As best shown in FIG. 2, a tray 32 is provided beneath each of the columns 18, and each tray 32 is sized to receive a respective translucent color filter 34. By installing a color filter 34 that transmits the desired color, the illuminating light from the light source 30 may be colored as desired before it is introduced into the columns 18. FIG. 3 shows the electrical connections for the light sources 30. These connections include plugs 36 that emerge via an access panel 38 in the base 12.

As shown in FIGS. 2 and 5, each of the columns 18 supports near its base a bubble source 40. Each bubble source 40 includes a cylindrical tube 42 that is mounted in place in an aperture in the sidewall of the respective column 18 via a fixture nut 44. Each of the tubes 42 is closed at the distal end and includes an array of apertures 46. Each of the bubble sources 40 is connected via tubing 48 and a check valve 50 to an air pump 52. The air pump 52 is electrically powered, and can be connected to a conventional source of electrical power via the plug 54. Preferably, the bubble sources 40 and the fixture nuts 44 are fabricated as described in detail in U.S. Pat. No. 5,349,771, assigned to the assignee of the present invention.

FIG. 7 shows one preferred arrangement for the tubing 48, check valves 50 and bubble sources 40. Note that multiple ones of the bubble sources 40. Note that multiple ones of the bubble sources 40 receive compressed air via a single output line from the air pump 52. In use, the air pump 52 supplies air under low pressure to the bubble sources 40, and this pressurized air escapes from the bubble sources via the apertures 46 near the bases of the columns 18.

As shown in FIGS. 2 and 6, a cap 56 is mounted near the top of each of the columns 18. The caps 56 are supported by the columns 18, and the caps 56 in turn support the top 16. Each of the caps 56 includes an opening 58 that allows air to escape from the interior of the column 18 while substantially preventing the escape of water. The caps 56 both provide excellent frictional contact against the top 16 as well as an escape path for air after it has left the water.

As shown in FIG. 8, each cap 56 may include an upper plate 60 sized to rest on the top of the leg 14 and a lower plate 62 sized to fit within the leg 14. Spacers 64 interconnect the plates. The upper plate supports an elastomeric element 64 that rests on the leg 14 and frictionally engages the top 16. Air is vented by notches 66 in the lower plate and a gap in the element 64 (not shown in FIG. 8, but visible in FIG. 6). The plates and the spacers are preferably made from clear acrylic.

In order to assemble the table 10 the light sources 30 are first positioned inside the base 12 beneath the color filter trays 32. Then the air pump 52 is positioned on the support 22 and the desired colored filters 34 are inserted into the trays 32. The bubble sources 40 are installed in the columns 18, and the bubble sources 40 are connected to the air pump 52 via the tubing 48 and the check valves 50. Then the columns 18 are inserted into the cutouts 26 in the housing 20. The notches 29 allow the fixture nuts 44 and the tubing 48 to enter the housing 20. Then the columns 18 are filled with a suitable liquid such as distilled water, and the caps 56 are placed on the tops of the columns 18. Finally, the table top 16 is installed in place on the caps 56.

After the table 10 is assembled, the light sources 30 are illuminated and the air pump 52 is activated, the result is a highly ornamental table. Air bubbles rise from the bubble sources 40 through the water in the columns 18, and these bubbles are illuminated by colored light that has passed through the filters 34.

Note that the area of the top 16 of the table 10 is substantially larger than the cross sectional area of the columns 18. This allows the table 10 to be used as a conventional coffee or end table.

Of course, it should be recognized that many changes and modifications can be made to the preferred embodiment described above. For example, the table of this invention is not limited to a table having the configuration and design of that shown in FIG. 1. The table of this invention can readily be adapted for use as a side table, a desk, a working table, a dinner table, a counter, a bar or a sideboard, with or without drawers. As used herein the term "table" is intended to cover a wide variety of furniture for supporting objects.

As used herein the term "table top" is intended to cover any surface for supporting objects, whether or not it is the upper-most element of the table.

The table 10 described above has a set of four legs. However, it should be understood that as used herein a set of legs may be limited to a single leg, as for example with a pedestal table. Alternately, a set of legs may include multiple legs such as two, three, four or more legs. Legs are said to support the top whether they support the top alone, or in combination with other elements, or even if they support the top visually but not structurally (as for example, when used with a cantilevered top).

The columns used for the legs can have any desired cross-sectional shape, and can be tapered, straight-legged, or of any other desired shape in elevation.

As described above, the columns are preferably translucent. This term is intended to denote that bubbles within the column can be seen from the exterior of the column, and is intended broadly to encompass both transparent and diffusing surfaces.

The term "pump" as used herein is intended to cover one or more pumping units that supply pressurized fluid to the bubble sources. In appropriate applications, a pump may include two separate pumping units, each supplying a pressurized fluid to a respective subset of the legs.

It should be understood that the foregoing detailed description has been intended by way of illustration, and not to define the invention. It is only the following claims, including all equivalents, which are intended to define the scope of this invention.

I claim:

1. A table comprising:

a top;

a set of legs supporting the top, at least one of said legs comprising:

a translucent column adapted to contain a liquid; and a bubble source mounted in the column to introduce bubbles into the liquid, said bubble source having an array of apertures; and a pump coupled to the bubble source to supply a pressurized fluid to the bubble source such that the fluid forms bubbles which rise through the liquid and are visible from outside the column;

said top having an upper surface, said column having a cross-section parallel to the upper surface, said upper surface having an area substantially greater than said cross-section.

2. The invention of claim 1 wherein the set of legs comprises a plurality of legs.

3. The invention of claim 2 wherein said at least one of said legs comprises a plurality of said legs, wherein each of said plurality of legs comprises a respective column and respective bubble source, and wherein the pump is coupled to the bubble source in a plurality of the columns.

4. The invention of claim 3 further comprising at least one light source aligned with the columns to direct light upwardly to illuminate bubbles in the columns.

5. The invention of claim 4 further comprising a plurality of color filters, each aligned with a respective one of the columns to color the light illuminating bubbles in the respective column.

6. The invention of claim 4, wherein said at least one light source is aligned such that at least two columns share at least one light source.

7. The invention of claim 3 wherein the plurality of legs comprises four legs.

8. The invention of claim 7 wherein the legs are positioned at respective corners of a rectangle.

9. The invention of claim 1, wherein said set of legs comprises at least one additional leg supporting the top, each of said additional legs comprising:

an additional translucent column adapted to contain the liquid;

an additional bubble source mounted in the additional column to introduce bubbles into the liquid;

wherein said pump is also coupled to said additional bubble source in a plurality of the columns to supply the pressurized fluid to each additional bubble source such that the fluid forms bubbles which rise through the liquid and are visible from outside each additional column.

10. The invention of claim 9 further comprising at least one light source aligned with the columns to direct light upwardly to illuminate bubbles in the columns.

11. The invention of claim 10, wherein said at least one light source is aligned such that at least two columns share at least one light source.

12. The invention of claim 10 further comprising a plurality of color filters, each aligned with a respective one of the columns to color the light illuminating bubbles in the respective column.

13. The invention of claim 1 further comprising a light source aligned with the column to direct light upwardly to illuminate the bubbles.

14. The invention of claim 13 further comprising a color filter aligned with the column to color the light illuminating the bubbles.

15. The invention of claim 1, wherein said translucent column is adapted to contain distilled water.

16. The invention of claim 1, wherein said array of apertures produces a dense arrangement of bubbles.

17. A table comprising:

a top;

a base;

a plurality of legs extending upwardly from the base and supporting the top; each of said legs comprising:

a translucent column adapted to contain a liquid; and a bubble source mounted in the column to introduce bubbles into the liquid; and a pump mounted in the base and coupled to the bubble sources in a plurality of the columns to supply air to the bubble sources such that the air forms bubbles which rise through the liquid and are visible from outside the columns;

wherein the legs are spaced apart from one another.

18. The invention of claim 17 further comprising at least one light source aligned with the columns to direct light upwardly to illuminate bubbles in the columns.

19. The invention of claim 18 further comprising a plurality of color filters, each aligned with a respective one of the columns to color the light illuminating bubbles in the respective column.

20. The invention of claim 18, wherein said at least one light source is aligned such that at least two columns share at least one light source.

21. The invention of claim 17 wherein said top comprises an upper surface, wherein each of said columns comprises a respective cross-section parallel to the upper surface, and wherein said upper surface comprises an area substantially greater than the combines area of the cross-sections.

22. The invention of claim 17 wherein said plurality of legs comprises four legs.

23. The invention of claim 22 wherein the four legs are positioned at respective corners of a rectangle.

24. The invention of claim 17, wherein said translucent column is adapted to contain distilled water.

25. The invention of claim 17, wherein the bubble source comprises an array of apertures.

26. The invention of claim 25, wherein said array of apertures produces a dense arrangement of bubbles.

27. A table comprising:

a top;

a set of at least two legs supporting the top, a plurality of said at least two legs comprising:

a translucent column adapted to contain a liquid; and a bubble source mounted in the column to introduce bubbles into the liquid; and a pump coupled to the bubble source to supply a pressurized fluid to the bubble source such that the fluid forms bubbles which rise through the liquid and are visible from outside the column;

at least one light source aligned with the column to direct light upwardly to illuminate bubbles in the column, said at least one light source aligned such that at least two columns share at least one light source;

said top having an upper surface, said column having a cross-section parallel to the upper surface, said upper surface having an area substantially greater than said cross-section.

28. The invention of claim 27, wherein the bubble source comprises an array of apertures.

29. The invention of claim 28, wherein said array of apertures produces a dense arrangement of bubbles.

30. The invention of claim 27, wherein the pump is coupled to the bubble source in a plurality of columns.

31. The invention of claim 27, wherein said translucent column is adapted to contain distilled water.

* * * * *